US005237788A

United States Patent [19]

Sandow

[11] Patent Number: 5,237,788

[45] Date of Patent: Aug. 24, 1993

[54] SKYLIGHT GUARD ASSEMBLY

[76] Inventor: Kiyoshi Sandow, 1534 Tournament Cir., Crosby, Tex. 77532

[21] Appl. No.: 785,947

[22] Filed: Oct. 31, 1991

[51] Int. Cl.[5] ..... E04B 7/18

[52] U.S. Cl. ..... 52/200; 52/202; 52/82; 49/463; 292/246

[58] Field of Search ..... 52/200, 202, 82; 292/246; 49/463

[56] References Cited

U.S. PATENT DOCUMENTS 1,233,530 7/1917 Whitnell .
1,236,008 8/1917 Rysdon .
1,302,729 5/1919 Thomas ..... 49/50
1,989,392 1/1935 Adams ..... 49/57
2,602,406 7/1952 Orter .
3,032,351 5/1962 Lewis ..... 49/57
4,571,897 2/1986 Kerr .

*Primary Examiner*—Richard E. Chilcot, Jr.
*Assistant Examiner*—Beth A. Aubrey
*Attorney, Agent, or Firm*—Gunn & Kuffner

[57] ABSTRACT

A skylight guard assembly having an arc-shaped wire mesh screen formed of longitudinal and transverse bars. A pair of receiving brackets are attached with fasteners to the frame of the skylight and the receiving brackets have a recess formed between two upwardly extending arms which receive the outermost longitudinal bars.

15 Claims, 3 Drawing Sheets

FIG. 1
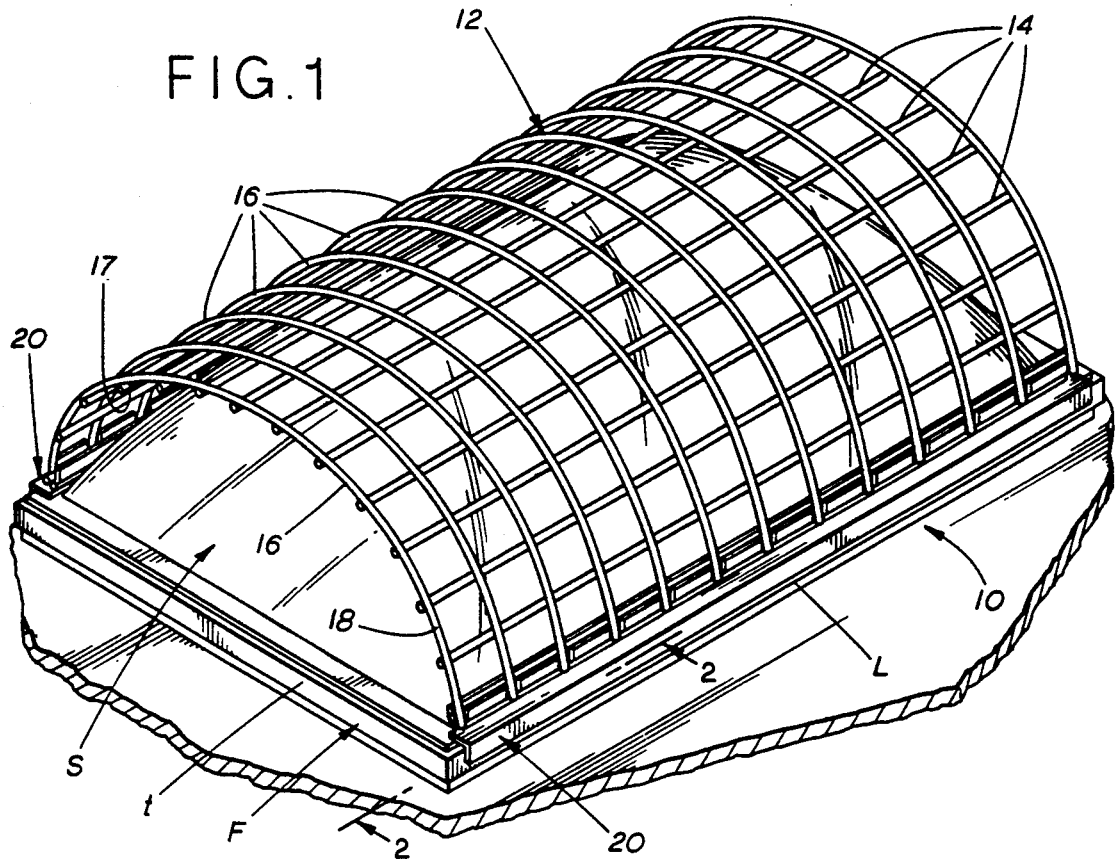
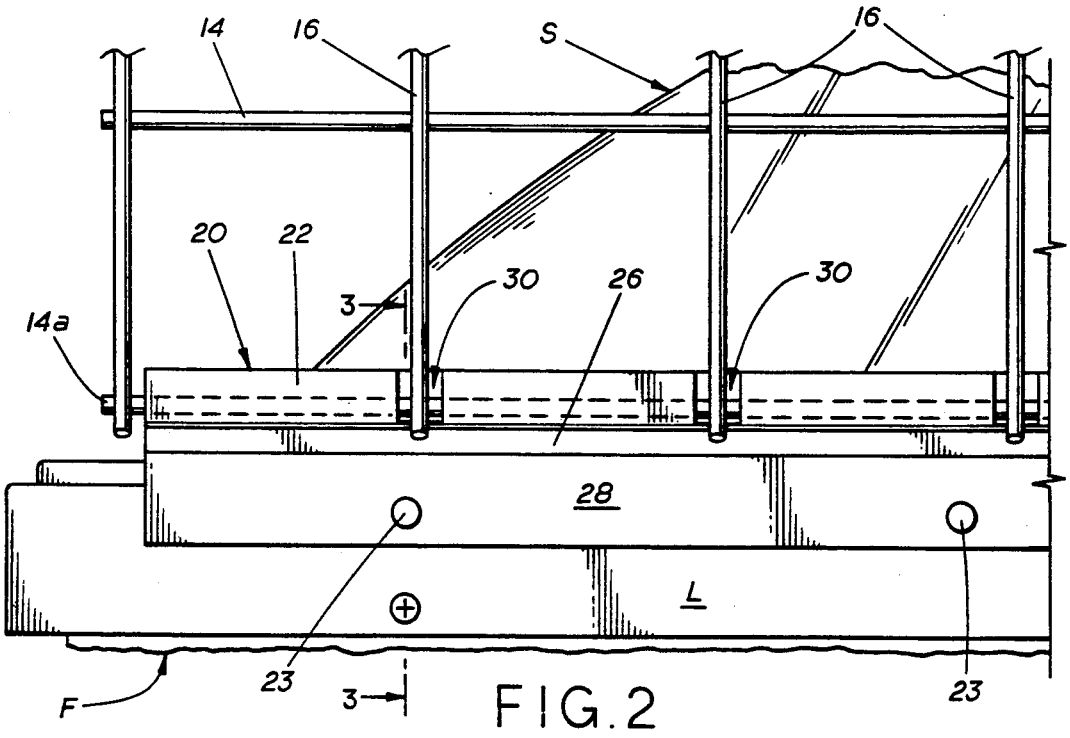
FIG. 2

SKYLIGHT GUARD ASSEMBLY

BACKGROUND OF THE INVENTION

1. Field of the Invention

The present invention relates to a skylight guard assembly and, more specifically, to a screen assembly which can be mounted to skylight frames.

2. Description of the Prior Art

Skylights come in various shapes and sizes including flat, plastic dome, pyramid, or continuous vaulted skylights. There are also heat and smoke vents with plastic domes. The majority of installed skylights are on relatively flat roofs of schools, warehouses, and manufacturing plants. Skylights on relatively flat roofs present a hazard during building construction, roof repair, and maintenance on mechanical units installed on the roof of the building. Every year, fatal falls result from failure to provide appropriate guarding and fall protection around skylights. Persons on the roof may stumble, back onto, sit or attempt to sit on the skylight, resulting in the person falling through the skylight. Skylights are not designed to support the weight of a person. Thus, a safety guard or railing is required to prevent persons from breaking the skylight and falling through the skylight opening.

It is well known in the art that one means for protecting against a person inadvertently falling through a skylight is to install a wire mesh or screen above a flat skylight to prevent a person from falling through the skylight. U.S. Pat. Nos. 1,233,530 and 1,236,008 disclose wire mesh positioned a short distance above a flat glass skylight and folded over the skylight frame. The wire mesh is stretched across the skylight and attached to lugs mounted on vertical faces of the skylight frame.

The Occupational Safety and Health Administration (OSHA) has recognized the dangers posed by skylights and has promulgated requirements for a standard skylight screen in 29 CFR 1910.23(e)(8) as follows:

> Skylight screens shall be of such construction and mounting that they are capable of withstanding a load of at least 200 pounds applied perpendicularly at any one area on the screen. They shall also be of such construction and mounting that under ordinary loads or impacts, they will not deflect downward sufficiently to break the glass below them. The construction shall be of grillwork with openings not more than 4 inches long or of slatwork with openings not more than 2 inches wide with length unrestricted.

Skylights also provide an unseen entry to a building for burglars. Thus, skylights should be protected against such unlawful entry by providing a guard assembly over the skylight which would deter burglars from breaking the skylight and gaining entry into the building.

It would be desirable to have a simple and economical skylight guard assembly for preventing skylight accidents which can be easily installed on existing skylights and also on new installations of skylights. Also, it would be desirable that the skylight guard assembly be adapted for use with either flat, dome, pyramid, or vaulted skylights. Additionally, it would be desirable to have a skylight guard assembly that would be a deterrent to criminal activity.

SUMMARY OF THE PRESENT INVENTION

Briefly, the present invention is an improved guard assembly for skylights. The guard assembly includes an arc-shaped wire mesh or screen which mounts in an upwardly extending groove formed in receiving brackets which are attached to two opposite sides of the skylight frame. The installed arc-shaped screen extends over the skylight and protects a person from breaking or falling through the skylight. A retaining cap can be attached to the uppermost ends of the receiving bracket forming the groove to secure the wire mesh or screen in the receiving brackets to the skylight frame. Additionally, the screen can be locked to the receiving brackets for security purposes.

BRIEF DESCRIPTION OF THE DRAWINGS

A better understanding of the present invention may be had by reference to the following drawings and contained numerals therein, of which:

FIG. 1 is a perspective view of the present invention showing the guard assembly mounted to a frame of a domed skylight;

FIG. 2 is a view taken along line 2—2 of FIG. 1;

DETAILED DESCRIPTION OF THE INVENTION

Figure 3:
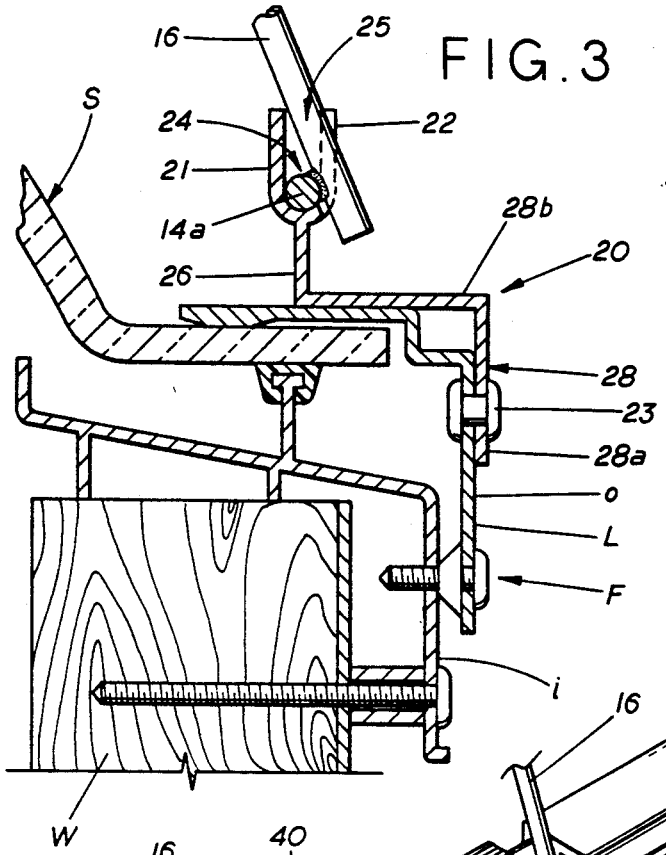
FIG. 3 is a view taken along line 3—3 of FIG. 2.

Referring to FIG. 1, a skylight guard assembly, designated generally as reference numeral 10, is shown comprising a wire mesh or screen 12 having a plurality of parallel-spaced longitudinal bars 14 attached to a plurality of parallel-spaced transverse bars 16. In the preferred embodiment, the longitudinal bars 14 contact a lower surface 17 of the transverse bars 16 and may be attached, for example, by spot welding so that the transverse bars 16 will always be on the outer surface of the guard assembly 10 when installed for reasons which will be explained below. Preferably, the screen 12 is formed of "×4" welded wire mesh with the diameter of the wire being dependent on the span of the guard assembly 10. The screen 12 should exhibit sufficient strength requirements when installed to prevent a person falling on the guard assembly 10 from deflecting and breaking the skylight, designated generally as S. Additionally, a 4"×4" wire mesh meets the OSHA requirement of openings not more than 4 inches long and minimizes the obstruction of light passing through the skylight S. Preferably, the wire mesh is flexible enough to allow the installer to slightly spring or bend by force the screen 12 during the installation of the screen 12 as will be explained below.

The screen 12 is bent to form an arc 18 as shown in FIG. 1. Preferably, the transverse bars 16 form the arc 18 and the longitudinal bars 14 are positioned along the inner periphery of the arc 18 so that the screen 12 can be properly mounted to a plurality of receiving brackets 20. Referring to FIG. 3, each receiving bracket 20 includes a pair of substantially upwardly extending arms, inner arm 21 and outer arm 22, having a recess 24 formed therebetween for receiving an outermost longitudinal bar 14*a*. The recess 24 includes an upwardly facing opening 25 with both the recess 24 and the opening 25 being wider than the diameter of the longitudinal bar 14*a* to be received in the recess 24. As shown in FIG. 3, the arms 21, 22 join one another at their lower ends where they form a generally straight upright portion 26 which is attached to a support member 28 having a substantially vertical portion 28*a* joined to a substantially horizontal portion 28*b*. As shown in FIGS. 1, 2, and 3, the support member 28 is fastened to a frame, designated generally as F, of the skylight S. The skylight frame F is typically attached to wooden framing, designated generally as W, defining the size of the skylight opening. The skylight frame F typically has a pair of longitudinal frame members L and a pair of transverse frame members t with each frame member L and t having an inner member i and an outer member o. As shown in FIG. 3, the inner member i is typically fastened to the wooden framing W and the outer member o is fastened to the inner member i with the skylight S securely positioned between the inner and outer members, i and o respectively. The support member 28 of the receiving bracket 20 is fastened by mechanical fasteners 23, welding, adhesive or any other suitable fastening means, to the outer member o of the longitudinal frame member L. In FIG. 3, the support member 28 is shown as being fastened to the outer member o with rivets 23. It should be noted that the receiving bracket 20 may also be manufactured integrally with the outer member o of the longitudinal frame member L.

Figure 5:
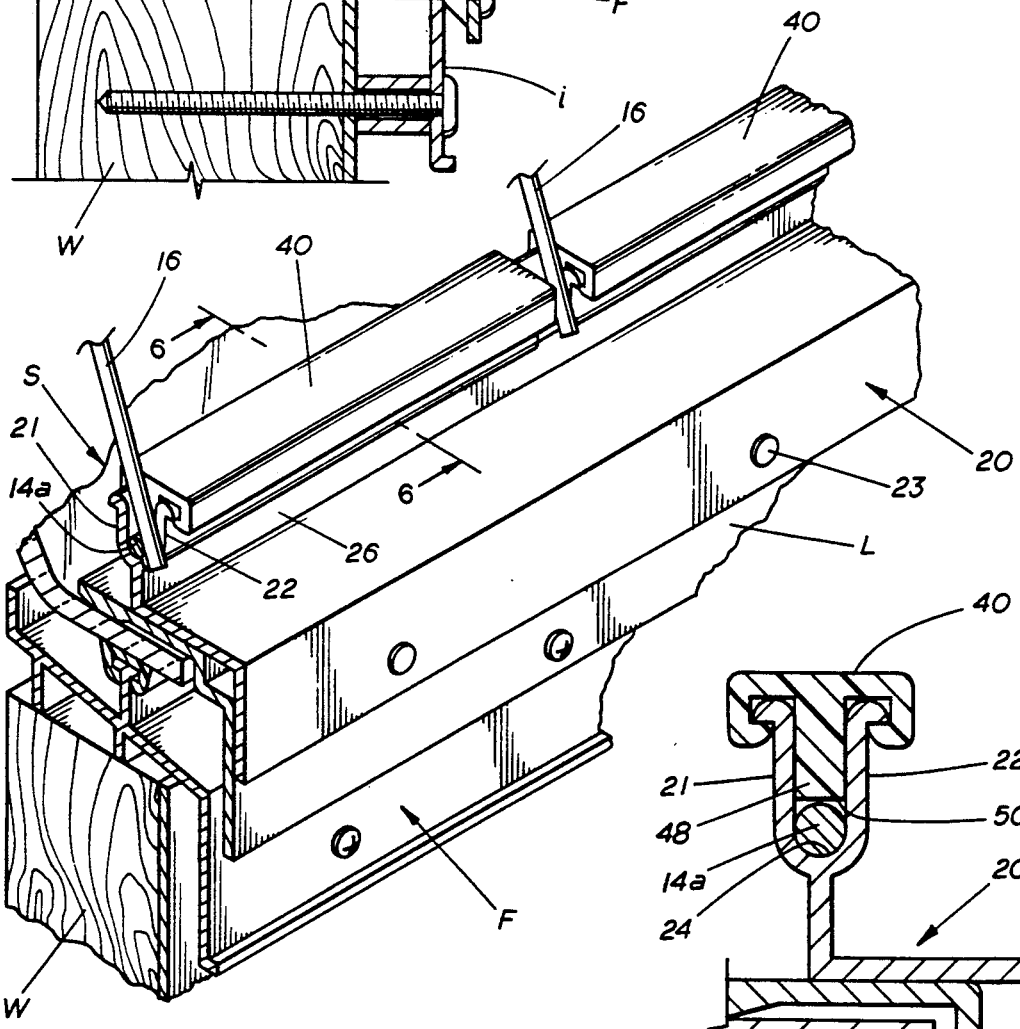
FIGS. 5 and 7 are perspective views of the present invention showing various alternate embodiments of a portion of the present invention.
Figure 7:
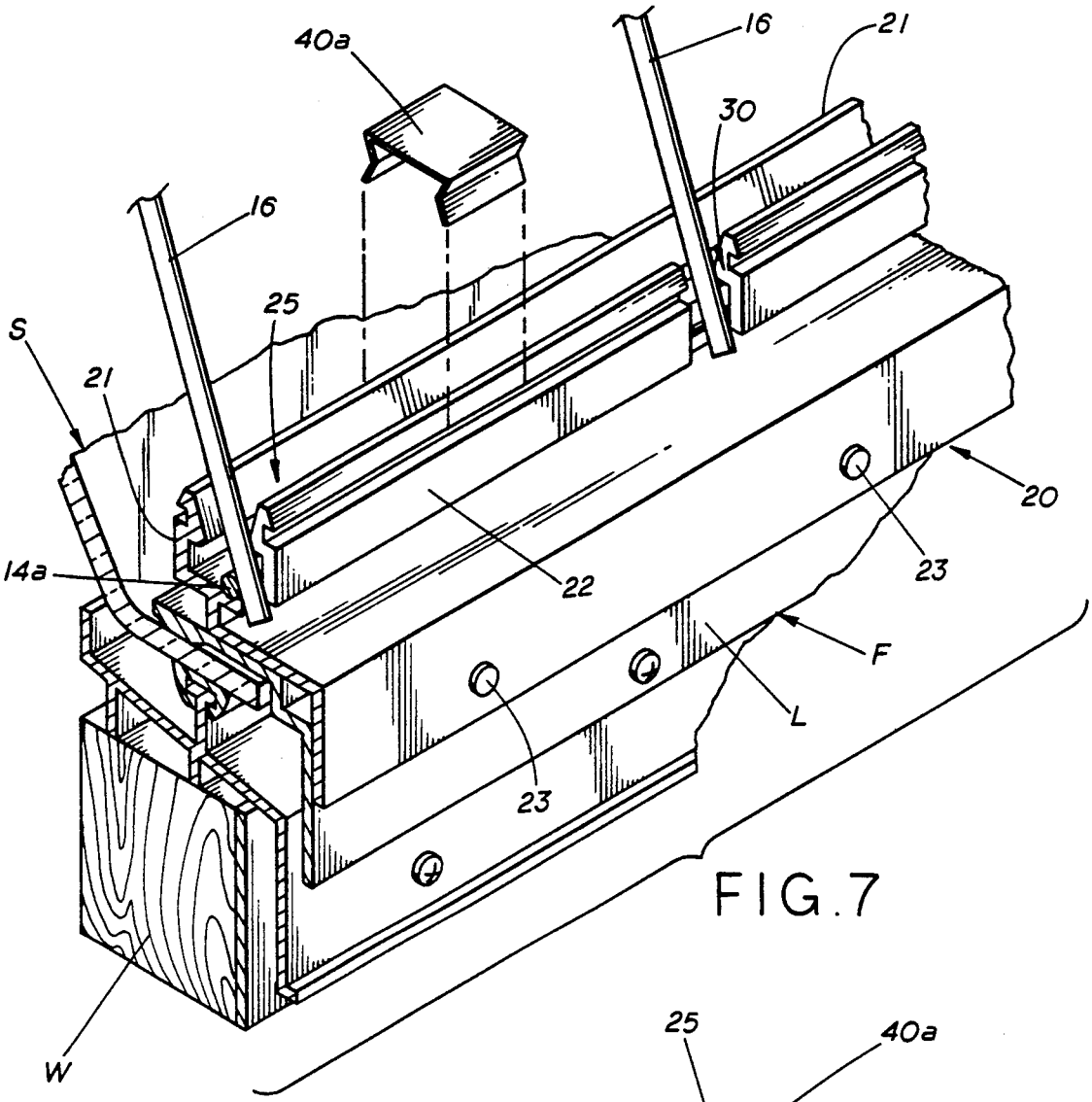

In the various embodiments as shown in FIGS. 1, 5, and 7, the receiving bracket 20 is a continuous bracket with a continuous recess 24 having a length approximating the length of the longitudinal frame members L. The continuous receiving bracket 20 includes a plurality of notches 30 in the outer arm 22 for receiving the transverse bars 16 when the outermost longitudinal bar 14*a* is fully positioned and seated in the recess 24. The notches 30 also provide for the drainage of rainwater that otherwise might accumulate in the recess 24. The continuous receiving bracket 20 also adds strength to the longitudinal frame members L.

Alternatively, the receiving brackets 20 can be short sections (not shown) having a length less than the spacing between adjacent transverse bars 16 so that no notches are necessary. However, the short-receiving brackets must be individually fastened to the longitudinal frame members L and properly located so as not to intersect with a transverse bar 16 when the longitudinal bar 14*a* is seated in the recess 24. Also, when using short-receiving brackets 20 it is not necessary that longitudinal bars 14 be on the inner periphery of the arc 18 since the transverse bars 16 will not intersect with the short-receiving brackets 20. Thus, the longitudinal bars 14 may be positioned either on the inner or outer periphery of the arc 18 formed by the transverse bars 16.

Figure 4:
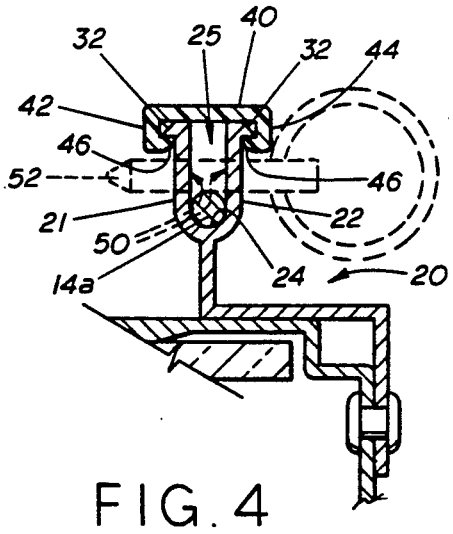
FIG. 4 is a cross-sectional elevation view of the present invention showing an alternate embodiment of a portion of the present invention.
Figure 6:
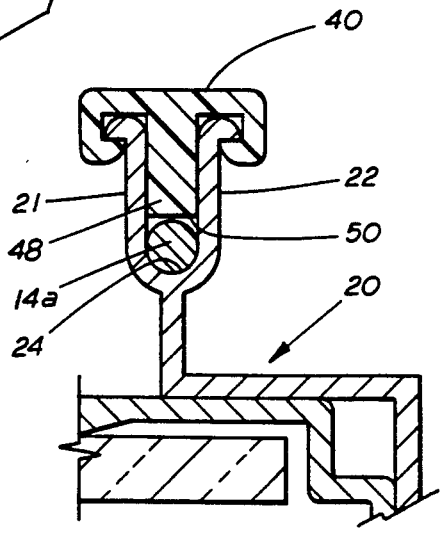
FIG. 6 is a view taken along line 6—6 of FIG. 5.

Referring now to FIGS. 3, 4, 6, and 8, a number of various cross-sectional receiving brackets 20 are shown. In FIG. 4, the inner and outer arms 21, 22 are shown having projecting lips 32 extending outwardly of the opening 25. A retaining cap 40 having a length less than the spacing between a pair of adjacent transverse bars 16 includes an inner and outer cap flange 42, 44, respectively. Each cap flange 42, 44 includes an inward lip 46 which engages the projecting lip 32 of the receiving bracket 20 to firmly secure the longitudinal bar 14*a* in the recess 24. As shown in FIG. 6, the retaining cap 40 also includes a middle flange 48 which extends into the recess 24 such that a lower face 50 of the middle flange 48 is closely positioned with the longitudinal bar 14*a* when installed on the receiving bracket 20 to minimize any vertical movement of the longitudinal bar 14*a*. As shown in FIG. 5, the retaining cap 40 is installed between a pair of transverse bars 16 and forms a snap fit with the arms 21, 22. The retaining cap 40 can be installed along the length of the longitudinal bar 14*a* between the transverse bars 16 at as many or as few places as desired. The retaining caps 40 prevent the longitudinal bar 14*a* from unseating from the recess 24 as a result of external forces acting on the screen 12 or from twisting or warping the screen 12 during installation. The retaining caps 40 may be made of plastic or metal having sufficient flexibility to permit easy installation of the caps 40.

Figure 8:
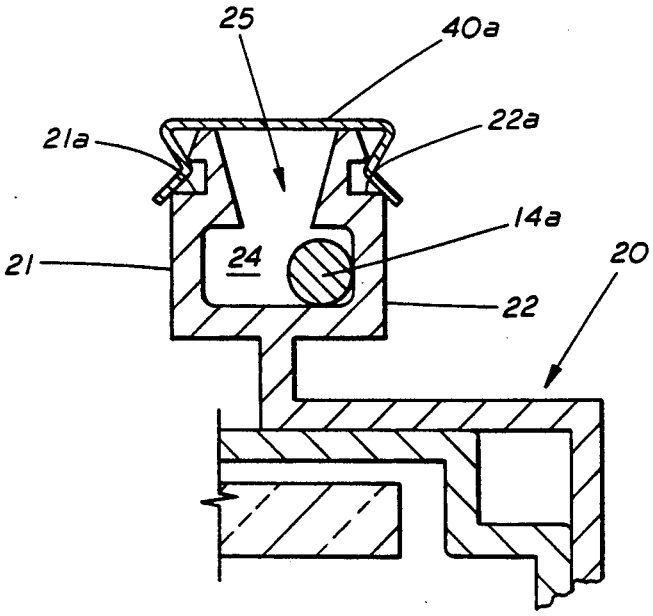
FIG. 8 is a cross-sectional elevation view of the alternate embodiment in FIG. 7 showing a retaining cap installed on the receiving bracket.

FIGS. 7 and 8 show another embodiment of the receiving bracket 20 in which the opening 25 is wider than the longitudinal bar 14*a* but the recess 24 is larger than the opening 25. The inner and outer arms 21, 22 include inwardly extending mid portions 21*a*, 22*a*, respectively, which terminate and extend upwardly to form the opening 25. The recess 24 is formed by the inwardly extending mid portions 21*a*, 22*a* and the lower portion of the inner and outer arms 21, 22. This configuration restricts vertical movement of the longitudinal bar 14*a* along the inner and outer part of the recess and requires that the longitudinal bar 14*a* be aligned in the center of the recess 24 below the opening 25 in order to have vertical movement of the longitudinal bar 14*a*. A retaining cap 40*a* is shown and functions similar to the retaining cap 40 shown in FIG. 4 as previously described. The retaining cap 40*a* may be made of plastic or metal and as shown in FIGS. 7 and 8 is preferably made of stainless steel for enhanced durability and to permit easy installation.

In FIG. 4, another means for securing the screen 12 to the receiving bracket 20 is shown. In this embodiment, a pair of axially aligned holes 50 are formed in the upper portion of the inner and outer arms 21, 22, respectively of the receiving bracket 20. The pair of holes 50 may be regularly spaced along the length of the receiving bracket 20. A fastener 52, as for example a pin or threaded bolt and nut, is inserted through the pair of holes 50 to secure and maintain placement of the screen 12.

If it is desired to prevent the unauthorized removal of the screen 12, a padlock (not shown) could be installed through the pair of holes 50. The padlock would provide added security against unlawful entry into the building by breaking the skylight.

To install the skylight guard assembly 10, the receiving brackets 20 are attached to the longitudinal frame members L of the skylight S by mechanical fasteners, welding, adhesive, or any other suitable fastening means. The receiving brackets 20, if continuous brackets, must be attached so that the notches 30 are opposite one another on the longitudinal frame members L so that the notches will correspond to the transverse bars 16. If the receiving brackets 20 are short sections, they must be positioned so as not to interfere with the transverse bars 16. After the receiving brackets 20 have been installed, the arc-shaped screen 12 having longitudinal bars 14 is lowered into the upwardly facing opening 25 in the receiving brackets 20. The flexibility and springiness of the screen 12 permits the width of the arc-shaped screen 12 to be adjusted to be received in the recesses 24 of the receiving brackets 20. The configuration of the arc-shaped screen 12 and the receiving brackets 20 allow great versatility in installing the skylight guard assembly 10 to a variety of skylights S from various manufacturers. Slight differences in the widths of skylights S and frame F are easily accommodated by the arc-shaped screen 12 having a sufficient arc length so that minor differences in the height and width of the skylight S as well as the width of the skylight frame F do not affect the protection provided by the skylight guard assembly 10.

After the longitudinal bars 14*a* are properly seated in the recesses 24, the retaining caps 40 can be snapped into place to maintain the screen 12 in the final position. Alternatively, fasteners 52 can be inserted through the pairs of holes 50 to maintain the screen 12 in its final position. Finally, for security purposes, padlocks can be inserted through the pairs of holes 50 to prevent unauthorized removal of the screens 12.

The arc-shaped screen 12 can be installed to protect the various shapes of skylights S. The arc 18 of the screen 12 provides great strength characteristics and is highly resistant to forces acting on the screen 12. The arc-shape also provides great versatility to accommodate minor differences in the height and width of skylights of various manufacturers without requiring exact measurements. Additionally, the mounting of the receiving bracket 20 is simple and can be mounted to skylight frames F without disassembly of the skylight S assembly.

The foregoing disclosure and description of the invention is illustrative and explanatory thereof, and various changes in the size, shape, and materials, as well as in the details of illustrative construction and assembly, may be made without departing from the spirit of the invention.

I claim:

1. A guard assembly for a skylight, comprising:

a screen having a plurality of longitudinal bars attached to a plurality of transverse bars, each said transverse bar forming an arc;

a plurality of receiving brackets, each said receiving bracket having a pair of upwardly extending arms forming a recess therebetween to receive one of the outermost said longitudinal bars; and means for attaching each said receiving bracket to the skylight.

2. The guard assembly according to claim 1, wherein the skylight includes a frame having a pair of longitudinal frame members and a pair of transverse frame members and said attaching means connects said plurality of receiving brackets to the longitudinal frame members.

3. The guard assembly according to claim 1, wherein at least one of said arms includes a plurality of notches at a spacing corresponding to the spacing of said plurality of transverse bars, said notches receiving said transverse bars when said longitudinal bar is received by said receiving bracket.

4. The guard assembly according to claim 1, further comprising a means for retaining said outermost longitudinal bar in said recess in said receiving bracket.

5. The guard assembly according to claim 4, wherein said retaining means comprises:

a lip outwardly protruding from each of said pair of arms; and a cap having reciprocal lips to engage said outwardly protruding lips.

6. The guard assembly according to claim 5, wherein said cap further includes a middle flange which extends in said recess and is positioned substantially adjacent to said outermost longitudinal bar to minimize the vertical movement of said outermost longitudinal bar.

7. The guard assembly according to claim 1, wherein said upwardly extending arms include inwardly extending midportions such that the width of said recess is greater than the width of said opening.

8. A safety guard assembly for a skylight, comprising:

a screen having a plurality of longitudinal bars and a plurality of transverse bars attached to each other;

means for receiving the outermost said longitudinal bars including a pair of upwardly extending arms having a recess formed therebetween, said recess having an opening at least as large as the diameter of said outermost longitudinal bars; and means for attaching the receiving means to the skylight.

9. The guard assembly of claim 8, further comprising a means for retaining said outermost longitudinal bar in said recess in said receiving means.

10. The guard assembly according to claim 8, wherein each of said pair of arms has an opening therethrough in axial alignment and said retaining means comprises a pin inserted through said opening in said pair of arms.

11. The guard assembly according to claim 8, wherein said retaining means comprises:

a lip outwardly protruding from each of said pair of arms; and a cap having reciprocal lips to engage said outwardly protruding lips.

12. The guard assembly according to claim 11, wherein said cap further includes a middle flange which extends in said recess and is positioned substantially adjacent to said outermost longitudinal bar to minimize the vertical movement of said outermost longitudinal bar.

13. A safety guard assembly for a skylight, wherein the skylight has a frame having a pair of longitudinal frame members and a pair of transverse frame members, said guard assembly comprising:

a screen having a plurality of longitudinal bars and a plurality of transverse bars attached to each other; and means, connected to each longitudinal frame member, for receiving the outermost said longitudinal bars of the screen, said receiving means including;

a support member connected to the longitudinal frame member and a pair of upwardly extending arms connected to said support member, said upwardly extending arms having a recess formed therebetween, said recess having an opening at least as large as the diameter of said outermost longitudinal bars.

14. The guard assembly according to claim 13, wherein at least one of said arms includes a plurality of notches at a spacing corresponding to the spacing of said plurality of transverse bars, said notches receiving said transverse bars when said longitudinal bar is received by said receiving means.

15. The guard assembly according to claim 13, wherein said upwardly extending arms includes inwardly extending mid-portions such that the width of said recess is greater than the width of said opening.

* * * * *